United States Patent [19]

Hoekstra et al.

[11] Patent Number: 4,457,374

[45] Date of Patent: Jul. 3, 1984

[54] TRANSIENT RESPONSE PROCESS FOR DETECTING IN SITU RETORTING CONDITIONS

[75] Inventors: George R. Hoekstra, Bolingbrook, John M. Forgac, Elmhurst, both of Ill.

[73] Assignee: Standard Oil Company, Chicago, Ill; Gulf Oil Corp., Pittsburgh, Pa.

[21] Appl. No.: 393,432

[22] Filed: Jun. 29, 1982

[51] Int. Cl.[3] ..... E21B 43/247; E21B 47/06

[52] U.S. Cl. ..... 166/251; 166/259; 166/261

[58] Field of Search ..... 166/251, 259, 260, 261; 299/2; 208/11 R

[56] References Cited

U.S. PATENT DOCUMENTS

| | | | |
|---|---|---|---|
| Re. 30,019 | 6/1979 | Lindquist | 166/251 |
| 3,044,543 | 7/1962 | Ramey, Jr. | 166/251 |
| 3,205,944 | 9/1965 | Walton | 166/251 X |
| 3,362,471 | 1/1968 | Slusser et al. | 166/251 |
| 4,151,877 | 5/1979 | French | 166/251 |
| 4,163,475 | 8/1979 | Cha et al. | 166/251 |
| 4,224,990 | 9/1980 | Cha | 166/251 X |
| 4,279,302 | 7/1981 | Cha | 166/251 |
| 4,315,656 | 2/1982 | Hall | 166/251 X |
| 4,369,842 | 1/1983 | Cha | 166/251 |

OTHER PUBLICATIONS

Van Poollen, "Transient Tests Find Fire Front in an In Situ-Combustion Project", *The Oil and Gas Journal*, vol. 63, No. 5, Feb. 1, 1965, pp. 78-80.

*Primary Examiner*—George A. Suchfield

*Attorney, Agent, or Firm*—Thomas W. Tolpin; William T. McClain; William H. Magidson

[57] ABSTRACT

A process is provided for determining retorting conditions in an in situ oil shale retort. In the process, the thickness of the hot shale zone is determined by monitoring the off gases in response to changing the feed conditions, such as the temperature or flow rate, of the feed gas. The location and depth of the hot shale zone can be determined by monitoring the response time and temperature of the off gases when the proportion of steam and air in the feed gas is changed. The depth of the mineral decomposition zone can be monitored by monitoring the amount of carbon dioxide produced when the air content of the feed gas is substantially reduced. The depth of the kerogen decomposition zone can be determined by monitoring the amount of hydrogen saturated gases produced when the inflow of air in the feed gas is stopped.

43 Claims, 3 Drawing Figures

TRANSIENT RESPONSE PROCESS FOR DETECTING IN SITU RETORTING CONDITIONS

BACKGROUND OF THE INVENTION

This invention relates to a process for use in underground retorting of oil shale, and more particularly, to a process for determining retorting conditions in an in situ oil shale retort.

Researchers have now renewed their efforts to find alternative sources of energy and hydrocarbons in view of recent rapid increases in the price of crude oil and natural gas. Much research has been focused on recovering hydrocarbons from solid hydrocarbon-containing material, such as oil shale, coal and tar sands by pyrolysis or upon gasification to convert the solid hydrocarbon-containing material into more readily useable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil is contained in oil shale deposits in the United States with almost 60 percent located in the rich Green River oil shale deposits of Colorado, Utah and Wyoming. The remainder is contained in the linear Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis for these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist and liquid droplets of shale oil and light hydrocarbon gases such as methane, ethane, ethene, propane and propene, as well as other products such as oil shale retort water, hydrogen, nitrogen, carbon dioxide, carbon monoxide, ammonia and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen and oil shale, known as retorting, to form liberated hydrocarbons can be done in in situ retorts under ground or in surface retorts above ground. In principle, the retorting of oil shale comprises heating the oil shale to an elevated temperature and recovering the vapors and liberated effluent. However, as medium grade oil shale yields approximately 20 to 25 gallons of oil per ton of shale, the efficiency of retorting is critical to the economic feasibility of a commercial opera- tion.

In in situ retorts, a flame front is continuously or intermittently passed through a bed of rubblized oil shale to liberate shale oil, off gases and oil shale retort water. There are two types of in situ retorts: true in situ retorts and modified in situ retorts. In true in situ retorts, all of the oil shale is retorted under ground as is, without mining or transporting any of the shale to aboveground locations. The shale can be explosively rubblized, if desired. In modified in situ retorts, some of the oil shale is mined and conveyed to the surface to create a cavity or a void space in the retorting area. The remaining underground oil shale above the void is then explosively rubblized to substantially fill the void. The oil shale which has been removed is conveyed to the surface and retorted above ground.

Over the years various methods have been suggested for detecting the location of the flame front and other retorting conditions in an in situ oil shale retort. Typifying these methods are those found in U.S. Pat. Nos. 4,082,145; 4,120,354; 4,148,529; 4,149,592; 4,150,722; 4,151,877; 4,162,706; 4,163,475; 4,166,721; 4,199,026; 4,223,726; 4,227,574; 4,249,602; 4,249,603; 4,252,374; 4,263,969; and 4,279,302. These prior art methods have met with varying degrees of success.

It is therefore desirable to provide an improved method or process for determining retorting conditions in an in situ retort.

SUMMARY OF THE INVENTION

An improved process is provided for determining retorting conditions in an in situ oil shale retort. The process is effective, efficient and relatively easy to use with underground retorting of oil shale. Desirably, the novel process enables the operator to expeditiously gather significant information about retorting conditions, and to quickly adjust the feed conditions according to the data obtained to enhance retorting efficiency and yield. The process can be safely carried out by the operator at a location above ground or some other remote location away from the the hot underground combustion zone of the retort.

During retorting, a flame front is ignited in the underground retort of raw oil shale to form a hot region. The hot region includes a kerogen decomposition zone in which shale oil and hydrogen saturated gases are evolved, a mineral decomposition zone in which carbon dioxide is evolved, and a reactive zone in which some of the shale oil is thermal cracked to evolve hydrogen unsaturated gases. Shale oil and off gases are liberated from raw oil shale in the hot region with heat emitted from the flame front, leaving retorted oil shale containing residual carbon. Residual carbon on the retorted shale is combusted by the flame front to form spent oil shale. The flame front is supported and advanced through the raw oil shale with an oxygen-containing feed gas under a first set of feed conditions.

In order to determine the thickness of the hot shale zone, the feed conditions are changed, preferably at least twice, while monitoring the off gas conditions. The feed conditions can be changed by changing the composition or flow rate of the feed gas. The feed gas contains air or oxygen to sustain the flame front and a diluent, preferably steam, to regulate the temperature of the flame front. Other diluents, such as nitrogen, carbon dioxide and recycled retort off gases can be used.

In one form, the proportion of steam and air in the feed gas are changed while continuously supporting and sustaining the flame front with the feed gas. The location and depth (thickness) of the hot region, as well as the cooler spent oil shale zone and the cold raw oil shale zone, can be determined by monitoring the change response time of the off gas temperatures. With this information, the time for thermal breakthrough of the off gases can be estimated to determine the extent of retorting.

The depth of the hot region and rate of combustion can be decreased by increasing the proportion of steam in the feed gas. The rate of advancement of the flame front can be controlled by regulating the feed gas flow rate. The yield of shale oil per ton of retorted oil shale can be determined by monitoring the production of shale oil.

The depth of the kerogen decomposition zone can be determined by monitoring the amount of hydrogen saturated gases, such as methane, ethane, or propane, in the off gases, when the amount of air in the feed gas is changed, preferably by stopping the inflow of air entering the retort. The amount of thermal cracking can be determined by monitoring the amount of hydrogen unsaturated gases, such as the ethylene or propylene, in the off gases in response to changing the air content or flow of the feed gas.

The depth of the mineral decomposition zone can be determined by monitoring the amount of carbon dioxide in the off gases in response to changing the amount or flow of air in the feed gas. In this particular method, the amount or proportion of air in the feed gas is substantially reduced, preferably by stopping the inflow of air entering the retort to attain the desired transient change in the feed gas. The response time of the changes can be determined to confirm the accuracy of these latter tests.

The inventive process is particularly useful in a generally upright, modified in situ retort, although it can also be used in true in situ retorts.

As used in this application, the terms "retorted oil shale" and "retorted shale" mean raw oil shale which has been retorted to liberate shale oil, leaving inorganic material containing residual carbon.

The terms "spent oil shale" and "spent shale" as used herein mean retorted oil shale from which most of the residual carbon has been removed by combustion.

A more detailed explanation of the invention is provided in the following description and appended claims taken in conjunction with the accompanying drawings.

DETAILED DESCRIPTION OF THE PREFERRED EMBODIMENT

Figure 1:
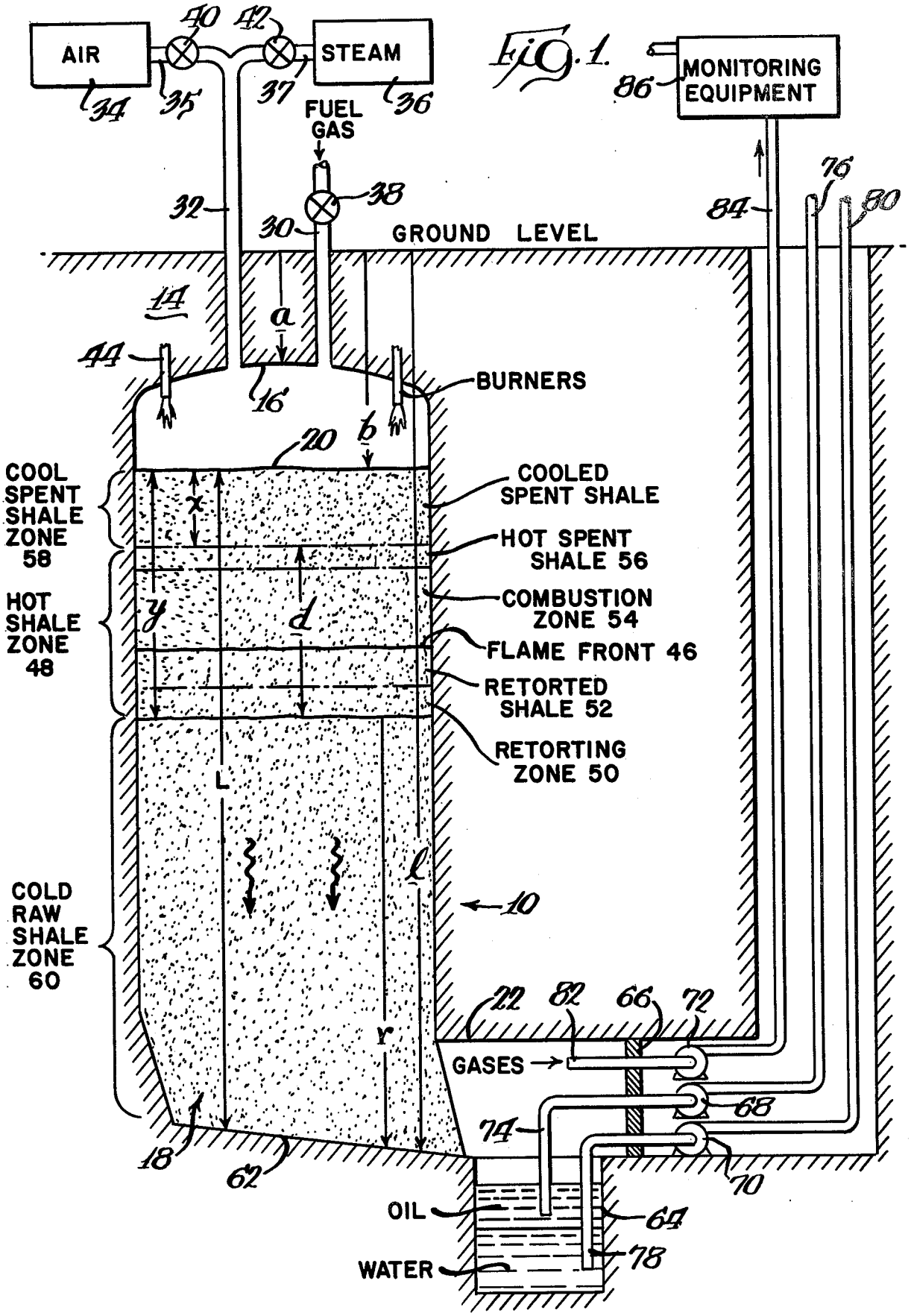
FIG. 1 is a schematic cross-sectional view of an in situ retort for carrying out a process in accordance with principles of the present invention.

A transient response process or method is provided for detecting in situ retorting conditions. The process is particularly useful to enhance retorting efficiency, effectiveness, product yield and quality. As shown in FIG. 1, the preferred process is carried out in an underground, modified in situ, oil shale retort 10, located in a subterranean formation 12 of oil shale. Retort 10 is covered with an overburden 14 and has a flat top or dome-shaped roof 16. The retort is elongated, upright and generally box-shaped and is substantially filled with a fluid permeable, rubblized, fragmented mass or bed 18 of raw oil shale. The top 20 of the bed is spaced below the roof 16.

The retort is formed by first mining an access tunnel or drift 22, extending horizontally into the bottom of the retort, and then removing from 2% to 40%, and preferably from 15% to 25%, by volume of the oil shale from the area to which the retort is to be formed, to define a cavity or void space. The removed oil shale is conveyed to the surface. The mass of oil shale above the cavity is then fragmented and expanded by detonation of explosives to substantially fill the void with the rubblized oil shale and form the rubblized mass 18.

The raw oil shale which has been conveyed to the surface is retorted later in an aboveground surface retort and combusted to form spent oil shale. The bulk density and heat capacity of the raw, retorted and spent shale obtained from the underground formation should be measured and determined, preferably with the help of standard laboratory testing equipment, for use in carrying out the process of this invention as more fully explained below.

A set of conduits or pipes 30 and 32 extend from above ground level through overburden 14, into the top 16 of the retort. pipes 30 and 32 include an ignition fuel line 30 and a feed gas line 32. Feed gas line 32 is connected to an air source 34, such as a compressor, air tank or pneumatic pump, and a steam source 36, such as a boiler, superheater or the effluent steam line of a fractionator. The extent and rate of fuel gas flowing through fuel gas line 30 and of air and steam flowing through feed gas line 32 are regulated and controlled by fuel gas valve 38, air valve 40 and steam valve 42, respectively. Burners 44 preferably extend between the roof 16 and the top 20 of the bed 18.

After the retort is formed, the depth from the surface or ground level to various portions of the retort should be measured, such as with measuring equipment commonly used in oil wells, prior to flame front ignition and retorting. Such depths should include the depth a (FIG. 1) to the roof 16 of the retort, the depth b to the top 20 of the rubblized mass 18, and the depth 1 to the bottom 62 of the retort. The overall length L of the retort 10 is the difference between depths 1 and b, i.e., depths 1-b. The amount of space between the top 20 of the rubblized mass and the roof 16 of the retort is the difference between depths b and a, i.e., depths b-a.

In FIG. 1, the depth x indicates the depth or thickness of the cool spent shale zone 58, i.e. the depth from the surface of the rubble to the bottom of the cool spent shale zone 58 and the top of the hot shale zone 48; and the depth y indicates the depth from the surface of the rubble to the bottom of the hot shale zone 48 and the top of the cold raw oil shale zone 60. The thickness or depth d of the hot zone 48 is the difference between depths y and x, i.e., depths y-x. The thickness or depth r of the cold raw oil shale zone 60 is the difference between depths L and y, i.e., depths L-y. In accordance with the transient response process described below, the depths x and y are determined from a location above ground or some other safe location remote from the hot shale zone 48, by monitoring the off gases and residence time for various changes in feed conditions of the feed gas, in order to determine the location and thickness (depths) of the cool spent shale zone 58, the hot shale zone 48, and the cold raw shale zone 60.

In order to commence retorting of the rubblized mass 18 of oil shale, a liquid or gaseous fuel, preferably a combustible ignition gas or fuel gas, such as recycled off gases or natural gas, is fed into the retort through fuel line 30, and an oxygen-containing, flame front-supporting, feed gas consisting essentially of air and steam is fed into the retort through feed gas line 32. Burners 44 are then ignited to establish a flame front 46 horizontally across the bed 18. If economically feasible or otherwise desirable, the rubblized mass 18 of oil shale can be preheated to a temperature slightly below its retorting temperature with an inert preheating gas, such as with recycled off gases, steam or nitrogen, before introduction of the feed gas and ignition of the flame front. After ignition, fuel gas valve 38 is closed to shut off inflow of fuel gas. Once the flame front is established, residual carbon contained in retorted rich oil shale usually provides an adequate source of fuel to maintain the flame front as long as the feed gas is supplied to the flame front. A supplemental fuel, such as shale oil or fuel gas, may be needed to help sustain the flame front through layers of lean oil shale.

The feed gas supports, drives and advances the flame front 46 downwardly through the bed 18 of oil shale. The feed gas is preferably a blend or mixture of air and steam, although air or steam alone can be used as the feed gas during part of the retorting. The air in the feed gas provides the source of oxygen to sustain and support the flame front. The steam in the feed gas controls the temperature of the flame front and the hot shale zone or region 48. Air and a diluent other than steam, such as recycled retort off gases, carbon dioxide or nitrogen, can also be used as the feed gas. Molecular oxygen can be used in lieu of or along with the air, as long as the feed gas has from 5% to less than 90%, and preferably from 10% to 30%, and most preferably a maximum of 20% by volume molecular oxygen. The proportion of air and steam in the feed gas, as well as flow rate of the feed gas, can be regulated and controlled by valves 40 and 42 to attain the desired retorting rate, efficiency and product yield.

Flame front 46 emits combustion off gases and generates heat which moves downwardly ahead of the flame front and heats the raw, unretorted oil shale in retorting zone 50. During retorting, retorting zone 50 moves downward leaving a layer or band 52 of retorted shale containing residual carbon. Retorted shale layer 52 above retorting zone 50 defines a retorted zone which is located between the retorting zone 50 and the flame front 46 of the combustion zone 54. Retorted shale is combusted in the combustion zone 54 leaving hot, spent, combusted shale 56. With time the upper portions of the spent shale are cooled by the incoming feed gas to form a cooled spent shale zone or region 58. The hot shale zone or region 48 includes hot spent shale 56, combustion zone 54, flame front 46, retorted shale 52 and retorting zone 50. Hot shale zone 48 is located between the cooled spent shale zone 58 and the cold raw oil shale zone 60. Cold raw oil shale zone 60 contains raw, unretorted oil shale below the hot zone 48.

The retorting zone portion 50 of the hot shale region 48 includes a kerogen decomposition zone, a mineral decomposition zone and a hot reactive zone. In the kerogen decomposition zone, shale oil and hydrogen saturated gases, such as methane, ethane and propane, are liberated and evolved from the kerogen in the raw oil shale. In the mineral decomposition zone, carbon dioxide is liberated and evolved from the raw oil shale. In the hot reactive zone, some of the liberated shale oil is thermal cracked to liberate and evolve hydrogen unsaturated gases, such as ethylene and propylene.

The off gases emitted during retorting are a mixture of shale oil vapors, steam, hydrogen saturated gases, hydrogen unsaturated gases, feed gas and effluent combustion gases including various amounts of hydrogen, carbon monoxide, ammonia, hydrogen sulfide, carbonyl sulfide, oxides of sulfur, and nitrogen. The composition of the off gases is dependent on the composition of the feed gas.

Shale oil and retort water produced during retorting flow downwardly by gravity and condense and liquify upon the cooler, unretorted raw oil shale in the cold raw oil shale zone 60, forming condensates which percolate downwardly through the retort into access tunnel 22.

The effluent product stream of liquid shale oil, oil shale retort water and retort off gases flow downwardly to the sloped bottom 62 of retort 10 and then into a collection basin and gravity separator 64, also referred to as a "sump" in the bottom of access tunnel 22. A vertical concrete wall 66 prevents leakage of off gas into the mine. The liquid shale oil, retort water and gases are separated by sedimentation and gravity in sump 64, and pumped to the surface by pumps 68 and 70 and blower 72, respectively, through inlet and return lines 74, 76, 78, 80, 82 and 84, respectively.

Effluent shale oil is dedusted in a cyclone, separated into fractions in a fractionator or quench tower, and processed further downstream in a hydrotreater or other upgrading equipment. Effluent retort water is filtered and/or otherwise treated before being discharged into a collection pond or recycled for use upstream or downstream. Raw retort off gases can be recycled as part of the fuel gas and/or feed gas, either directly or after the water vapors and shale oil vapors have been stripped away in a quench tower or scrubber. Part of the off gas can also be sent to a stack and/or flared.

During retorting effluent retort gases are monitored with analytical, measuring and monitoring equipment 86. Equipment 86 includes: a gas chromatograph or gas detector for analyzing the off gas composition; a thermometer for measuring the off gas temperature; a clock or stopwatch for measuring the transient response time for changes in off gas composition; and a flow meter for measuring the off gas flow rate. Monitoring equipment 86 can also be operatively connected to feed gas line 32, air line 35 and steam line 37 to monitor the composition, temperature and flow rate of the feed gas, air and steam. Alternatively, the feed gas, air and steam lines can be connected to separate monitoring equipment. Shale oil production is measured in volume by barrels.

Figure 2:
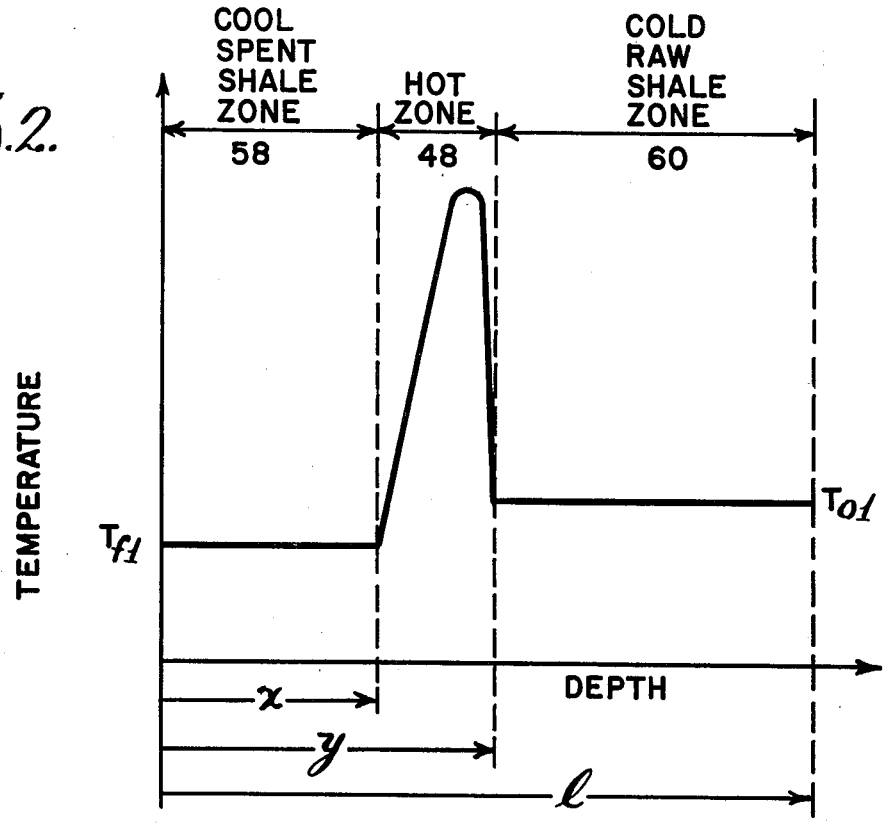
FIG. 2 is a graph of gas flow through the retort.

Referring now to FIG. 2, FIG. 2 illustrates the temperature profile of influent feed gas and effluent retort off gases in the retort during retorting. The influent feed gas passes downwardly through cool dried spent shale in the cool spent shale zone 58 at the saturation temperature $T_{fl}$ of the feed gas. The saturation temperature of the feed gas depends upon the composition of the feed gas, i.e., the proportion of air and steam or other diluent in the feed gas. As the feed gas passes through the hot shale zone or region 48, the feed gas is heated to a substantially higher temperature. Effluent retort off gases leaving the hot zone 48 are a mixture of feed gas, combustion gases and product gases liberated from the raw oil shale and thermal cracked from the liberated shale oil. The effluent retort off gases pass downwardly through the cold raw shale in cold raw shale zone 60, at the saturation temperature $T_{o1}$ of the effluent retort off gases. The saturation temperature of the effluent retort off gases depends upon the composition of the off gases.

The composition of the off gases depends upon the feed gas composition as well as the kerogen and mineral content of the oil shale in the retorting zone.

Figure 3:
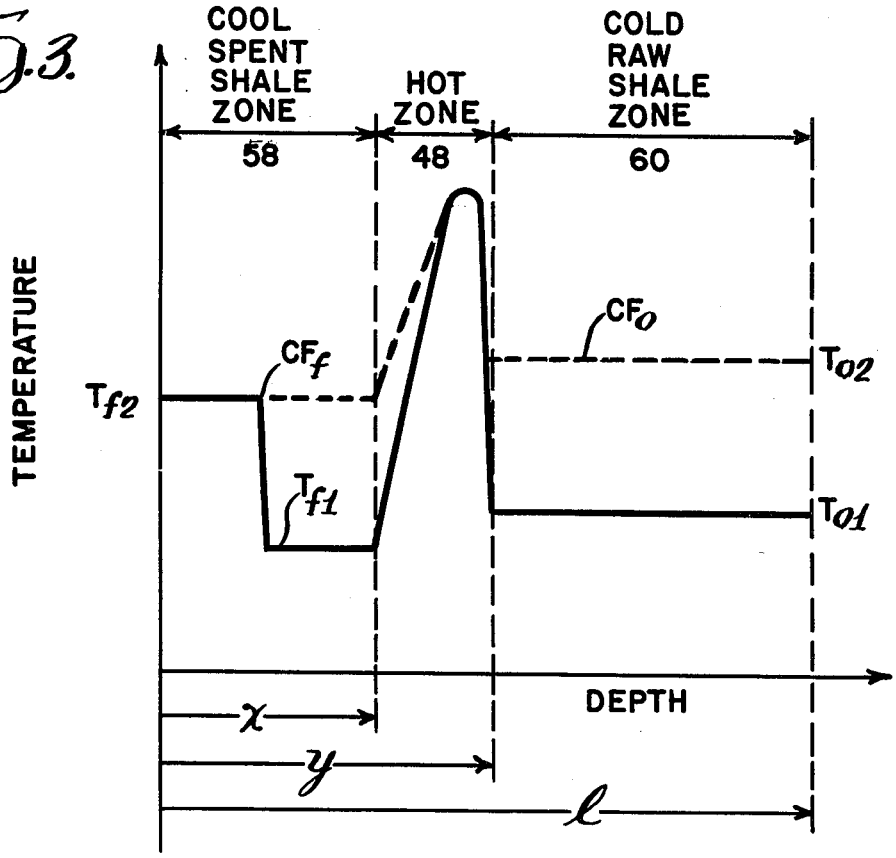
FIG. 3 is a graph of gas flow through the retort in response to a change in feed gas conditions.

As shown in FIG. 3, when the proportion of air and steam in the influent feed gas is changed, steam in the new feed gas will pass through the cool spent shale zone 58 at the saturation temperature $T_{f2}$ of the new feed gas composition. The steam condenses on the cool spent shale. The latent heat of condensation of the steam warms the cool spent shale to an equilibrium temperature, generally equal to the new saturation temperature $T_{f2}$ of the feed gas. As steam continues to condense in the retort, warming the cool spent shale, a feed gas condensation front $CF_f$ (FIG. 3) at the new saturation temperature $T_{f2}$, moves down through the spent shale zone 58 until the spent shale zone is entirely heated to the new saturation temperature $T_{f2}$.

When the feed gas condensation front $CF_f$ (FIG. 3) reaches the top of the hot zone 48, it contacts shale which is substantially hotter than the new saturation temperature $T_{f2}$ of the influent feed gas. Steam contained in the effluent retort off gases produced in the hot zone 48 will freely flow downwardly in the hot zone without condensing.

Steam contained in the effluent retort off gases contacts cold raw shale in the cold raw shale zone 60 (FIG. 3) at a temperature below the dew point of the off gases, forming an off gas condensation front $CF_o$. The off gas condensation front $CF_o$ passes through the raw shale zone at the saturation temperature $T_{o2}$ of the new off gas composition. Steam in the new off gas composition condenses on the raw shale in the cold raw shale zone 60 with the latent heat of condensation warming the cold raw shale to an equilibrium temperature generally equal to the new off gas saturation temperature $T_{o2}$.

The velocity v of the feed gas and feed gas condensation front $CF_f$ passing through the spent shale zone 58, and the off gases and off gas condensation front $CF_o$ passing through the raw shale zone 60 are determined by the following general equation:

$$v = \frac{HS}{mc\Delta T}$$

When calculating the velocity $v_{f1}$ of the feed gas and the feed gas condensation front $CF_f$ passing downward through the spent shale zone 58 in accordance with the above equation: H represents the heat vaporization of the steam in the influent feed gas, which can be obtained from standard steam tables; S represents the flow rate of the influent feed gas, which is determined by a flow meter connected to feed gas line 32 (FIG. 1); m represents the bulk density of the spent shale, which has been previously determined; c is the heat capacity of the spent shale which has been previously determined; and $\Delta T$ represents the difference in the new saturation temperature $T_{f2}$ of the feed gas and the old saturation temperature $T_{f1}$ of the feed gas, i.e., $T_{f2}-T_{f1}$. The new and old saturation temperatures of the feed gas can be determined from standard steam tables based upon the proportion of steam in the feed gas or from a temperature sensor in the cool spent shale zone.

When calculating the velocity $v_{o1}$ of the off gases and off gas condensation front $CF_o$ flowing downward through the raw shale zone 60 in accordance with the above equation: H represents the heat of vaporization of the steam in the effluent retort off gases, which can be obtained from standard steam tables; S is the flow rate of the off gases, which is determined by a flow meter in monitoring equipment 86; m is the bulk density of the raw oil shale, which has been previously determined; c is the heat capacity of the raw shale, which has been previously determined; and $\Delta T$ represents the difference in the new saturation temperature $T_{o2}$ of the off gases and the old saturation temperature $T_{o1}$ of the off gases, i.e., $T_{o2}-T_{o1}$. The new and old saturation temperatures of the off gases can be determined from standard steam tables based upon the proportion of steam in the off gases or from a temperature sensor in the cold raw oil shale zone.

In a commercial sized retort, the thickness or depth of the hot zone 48 (FIG. 1) is relatively small (thin) compared to the thickness or depth s of the spent shale zone 58 and the depth r of the raw oil shale zone 60. In such circumstances, the location of the hot shale zone can be estimated with only a very small margin of error by assuming the depths x and y (FIG. 1) to the top and bottom of the hot zone 48 are equal, i.e., depths $x-y=o$. Depths x and y can be determined by the following equation:

$$x = y = \frac{t - \frac{L}{v_o}}{\frac{1}{v_f} - \frac{1}{v_o}}$$

wherein t represents the response time, also referred to as the "transient response time," "residence time" or "delay time," for the off gas to change from the old off gas composition to the new off gas composition, after the influent feed gas composition (air/steam ratio) has been changed; $v_f$ is the velocity of the feed gas or feed gas condensation front, as explained above, and $v_o$ is the velocity of the off gases or off gas condensation front as explained above.

When the proportion of air and steam in the feed gas is changed a second time, a new (second) feed gas condensation front and off gas condensation front will advance downward through the spent shale zone 58 and raw shale zone 60, respectively. The velocity $v_{f2}$ of the second feed gas condensation front and the velocity $v_{o2}$ of the second off gas condensation front is determined by the general basic velocity equation above. The value of $\Delta T$ of the $v_{f2}$ equation is the difference between the new saturation temperature $T_{f3}$ of the influent feed gas and the old saturation temperature $T_{f2}$ of the feed gas, i.e., $T_{f3}-T_{f2}$. The value of $\Delta T$ in the $V_{o2}$ equation is the difference between the new saturation temperature $T_{o3}$ of the effluent retort off gases and the old saturation temperature $T_{o2}$ of the effluent retort off gases, i.e., $T_{o3}-T_{o1}$. The values of H, S, m, and c in the equation for velocity $v_{f2}$ of the new feed gas condensation front are the same as in the equation for the velocity $v_{f1}$ discussed above, for the old feed gas condensation front. The values of H, S, m, and c in the equation for the velocity $v_{o2}$ of the new off gas condensation front are the same as in the equation for the velocity $v_{o1}$ discussed above, for the old off gas condensation front.

The transient response time or delay t, from the time the feed gas composition was changed to the time changes in the effluent front off gas temperature are observed, is measured with a stopwatch or clock. The transient response time is related to depths x, y and L (FIG. 1), and to velocities vf and vo, as follows:

$$t = \frac{x}{v_f} + \frac{(L - y)}{v_o}$$

The depth x (FIG. 1) of the cool spent shale zone 58, i.e. the depth from the top of the rubble to the bottom of the spent shale zone 58 and the top of the hot shale zone 48 is determined by the equation:

$$x = \frac{v_{f2}[v_{f1}v_{o1}t_1 - v_{f1}v_{o2}t_2]}{[v_{f2}v_{o1} - v_{f1}v_{o2}]}$$

where $t_1$ is the elapsed time or transient response time between the first change of the influent feed gas composition to the resultant effluent retort off gas composition; $t_2$ is the elapsed time or transient response time between the second change of the influent feed gas composition to the resultant change in the effluent retort off gas temperature; $v_{f1}$ is the velocity of the first feed gas condensation front as discussed above; $v_{f2}$ is the velocity of the second feed gas condensation front as discussed above; $v_{o1}$ is the velocity of the first off gas condensation front as discussed above; and $v_{o2}$ is the velocity of the second off gas condensation front as discussed above.

The depth y (FIG. 1) from the top of the rubble to the bottom of the hot zone 48 and the top of the raw shale zone 60 is determined by the equation:

$$y = \frac{v_{o2}x}{v_{f2}} + L - v_{o2}t_2$$

wherein the designations $v_{o2}$, x, L, $t_2$ and $v_{f2}$ are discussed above.

Knowing the depths x and y (FIG. 1) can be of considerable benefit during retorting. If the thickness or depth d of the hot zone, which is equal to y−x, is large, the steam/air ratio can be increased to retard the rate of combustion and shale oil burning, while maintaining steady heat flow down the bed.

The extent of retorting, i.e., the depth of oil shale which is being or has been retorted, is indicated by y (FIG. 1). The depth of unretorted, raw oil shale is determined by the equation: L−y. The time in which thermal breakthrough of off gases will occur, i.e., when retorting is essentially complete, is directly proportional to the above depths and relationships. An on-line estimate yield of shale oil per ton of retorted oil shale can be determined by monitoring the amount of shale oil produced during retorting. Retorting efficiency and effectiveness are directly proportional to the oil yield, depths and relationships discussed above.

For example, the following values and data are obtained in accordance with the above transient response process and equations, when the influent feed gas composition is changed volumetrically from 100% air, to 70% air and 30% steam, and then subsequently to 50% air and 50% steam, at a generally constant flow rate of 2 SCFM/ft$^2$ in a 600 foot high (overall length) in situ retort: x=200 ft; y=450 ft; d=250 ft; a=390 ft; b=400 ft; l=1000 ft; r=150 ft; H=1000 BTU/lb; $S_f$=1.7 lb/hr ft$^2$; $m_s$=100 lb/ft$^3$; $c_s$=0.2 BTU/lb °F.; $T_{f1}$=60° F.; $T_{f2}$=148° F; $T_{f3}$=170° F.; $v_{f1}$=0.97 ft/hr; $v_{f2}$=5.8 ft/hr; $S_o$=2.1 lb/hr ft$^2$; $m_r$=100 lb/ft$^3$; $c_r$=0.2 BTU/lb °F.; $T_{o1}$=125° F.; $T_{o2}$=150° F.; $T_{o3}$=175° F.; $v_{o1}$=4.2 ft/hr; $v_{o2}$=6 ft/hr; $t_1$=242 hours; $t_2$=59.5 hours; L=600 ft.

If in the above example the hot zone 48 is assumed to be very thin compared to the overall length of the retort, applying the above equation where x=y yields a value for x and y of 125 feet.

If the thickness d of the hot shale zone 48 is already known, the location of depths x and y can be determined in accordance with the following equations:

$$y = d + x$$

$$x = \frac{\left[t_1 - \frac{L - d}{v_{o1}}\right]}{\left[\frac{1}{v_{f1}} - \frac{1}{v_{o1}}\right]}$$

wherein the designations d, t, L, $v_{o1}$ and $v_{f1}$ are discussed above. For example, if the thickness d of the hot zone 48 is known or estimated to be 20 feet, then in applying the values of $v_{f1}$ and $v_{o1}$ in the first example x=131 ft. and y=151 ft.

The depth of the mineral decomposition zone can also be determined by monitoring the change in the amount of carbon dioxide in the effluent retort off gases as a result of changing the amount of air in the influent feed gas, along with monitoring the off gas temperature and the transient response time. Changing the carbon dioxide concentration in the off gases can be accomplished by substantially reducing the proportion of air in the feed gas, preferably by stopping the inflow of air in the feed gas while maintaining the flow of diluent, such as steam, carbon dioxide, nitrogen, or recycled retort off gases, in the feed gas. When the air flow is shut off, the flame front is extinguished and combustion stops, but pyrolysis reactions such as carbonate decomposition, carbon dioxide emission and char gasification continue. Initially, the concentration of gaseous products, such as carbon dioxide, carbon monoxide, hydrocarbons and hydrogen, will increase in response to the reduced flow of combustion product gases and nitrogen. The concentration of these gases changes with time, as the composition of the hot reactive shale and thermal conditions of the retort change.

The carbon dioxide concentration will normally increase when air is shut off because of the reduced flow of nitrogen from combustion. The carbon dioxide concentration, however, will quickly peak and then decline gradually as the mineral carbonates on the hot shale are depleted of carbon dioxide. The initial increase in carbon dioxide concentration and the subsequent rate of decline in carbon dioxide concentration are directly proportional and indicative of the thickness or depth of the mineral decomposition zone. If the mineral decomposition zone is relatively thick, the carbon dioxide concentration will be relatively high immediately after the air is shut off. The carbon dioxide concentration will decay slowly with time. If the mineral decomposition zone is relatively thin, there will be little or no increase in carbon dioxide concentration in the off gases. Any carbon dioxide production which does occur from the thin mineral decomposition will decelerate rpaidly after the air is shut off.

Information concerning the depth of the kerogen decomposition zone is very useful. If carbon dioxide evolution from carbonate decomposition is very high in the absence of combustion, it can be concluded that there is a large inventory of hot shale in the retort. In such event, milder combustion conditions, for example, a feed gas volumetric composition of 50% air and 50% steam, may be in order to decrease carbonate decomposition and carbon dioxide evolution so as to increase product yield and quality, and retorting efficiency.

The depth of the kerogen decomposition zone can be determined by monitoring the amount of hydrogen saturated gases, such as methane, ethane and/or propane, in the effluent retort off gases, in response to changing the amount of air in the influent feed gas, along with monitoring the off gas temperature and transient response time. This can be accomplished by substantially reducing the proportion of air in the feed gas, preferably by stopping the inflow of air in the feed gas while continuing the flow of the diluent in the feed gas. A preferred diluent is steam, although other diluents, such as recycled retort off gases, nitrogen and carbon dioxide, can be used. The amount of hydrogen saturated gases in the off gases is directly proportional and indicative of the depth or thickness of the kerogen decomposition zone.

Heat generated by the flame front 46 and the kerogen decomposition zone thermal cracks a portion of the shale oil produced from the raw oil shale during retorting. Hydrogen unsaturated gases, such as ethylene and propylene, are evolved from the shale oil as a result of thermal cracking. The extent or amount of thermal cracking can be determined by monitoring the amount of hydrogen unsaturated gases, such as ethylene and/or propylene, in the off gases, as a result of changing the amount of air in the feed gas, along with monitoring the off gas temperature and transient response time. As in the above procedure, this can be accomplished by substantially reducing the proportion of air in the feed gas, preferably by stopping the inflow of air in the feed gas while continuing the flow of the diluent, such as steam, in the feed gas. The amount of hydrogen unsaturated gases produced is directly proportional and indicative of the amount and extent of thermal cracking.

Information about the extent of thermal cracking is very useful. If the amount of thermal cracking is relatively high, the proportion or concentration of steam in the feed gas can be increased to decrease the temperature in the hot zone 48 so as to effectively decrease the rate and extent of thermal cracking.

The above transient response procedure can be combined with the preceding transient response procedure in which the steam concentration is changed to indicate the proximity of oil producing regions to extremely hot zones, as well as the extent of oil degradation. If severe oil degradation is indicated, the retorting rate should be lowered by decreasing the flow of influent feed gas in order to allow the effluent shale oil to drain away from the extremely hot zones. Higher retorting rates can be resumed after severe degradation subsides.

Feed changes for the above transient response procedures can be instituted as part of the run schedule for the retort, preferably at times which minimize disruption of retort operations. The change of feed conditions should be of sufficient magnitude to permit the observation of the response in measured quantities. The monitored data and calculated values from the above transient response procedures can be compared with other retorts being processed at the same time, as well as to changes observed earlier in the operation and to predictions based upon theoretical computer models.

Although embodiments of the above process have been shown and described, it is to be understood that various modifications and substitutions, as well as rearrangements and combinations of process steps, can be made by those skilled in the art without departing from the novel spirit and scope of this invention.

What is claimed is:

1. A process for use in underground retorting of oil shale, comprising the steps of:

igniting a flame front in an underground retort of raw oil shale to form a hot zone;

liberating shale oil and off gases from said raw oil shale in said hot zone with heat emitted from said flame front, leaving retorted oil shale containing residual carbon;

combusting said residual carbon on said retorted shale with said flame front to form spent oil shale;

advancing said flame front through a portion of said raw oil shale;

supporting said flame front and said advancement with an oxygen-containing gas under a first set of feed conditions;

changing said feed conditions; and determining the thickness of said hot zone by monitoring said off gases in response to the change of feed conditions.

2. A process in accordance with claim 1 including detecting the location of said hot zone by monitoring said off gases in response to said change of feed conditions.

3. A process in accordance with claim 1 including determining the thickness of said raw oil shale by monitoring said off gases in response to said change of feed conditions.

4. A process in accordance with claim 1 including determining the thickness of said spent oil shale by monitoring said off gases in response to said change of feed conditions.

5. A process in accordance with claim 1 including monitoring the temperature of said off gases.

6. A process in accordance with claim 1 including monitoring the composition of said off gases.

7. A process in accordance with claim 6 including monitoring the carbon dioxide content of said off gases.

8. A process in accordance with claim 6 including monitoring the hydrogen saturated gases in said off gases.

9. A process in accordance with claim 1 wherein part of said shale oil is thermal cracked during said advancement and the extent of thermal cracking is determined by monitoring the hydrogen unsaturated gases in said off gases.

10. A process in accordance with claim 1 wherein said oxygen-containing gas contains steam and said feed conditions are changed by changing the amount of steam in said oxygen-containing gas.

11. A process in accordance with claim 1 wherein said oxygen-containing gas contains air and a diluent, and said feed conditions are changed by changing the amount of air in said oxygen-containing gas.

12. A process in accordance with claim 11 wherein said feed conditions are changed by substantially stopping the inflow of air.

13. A process in accordance with claim 1 wherein said feed conditions are changed by changing the flow rate of said oxygen-containing gas.

14. A process in accordance with claim 1 including monitoring the rate of change.

15. A process in accordance with claim 1 wherein said retort is a true in situ retort.

16. A process in accordance with claim 1 wherein said retort is a modified in situ retort.

17. A process in aocordance with claim 1 wherein said retort is a vertical in situ retort.

18. A process in accordance with claim 1 wherein said hot zone includes a reactive zone.

19. A process in accordance with claim 1 wherein said hot zone includes a mineral decomposition zone.

20. A process in accordance with claim 1 wherein said hot zone includes a kerogen decomposition zone.

21. A process for use in underground retorting of oil shale, comprising the steps of:

igniting a flame front across a generally upright, modified in situ retort;

liberating shale oil and carbon dioxide from said raw oil shale in a mineral decomposition zone with heat generated by said flame front;

supporting said flame front with a feed gas containing air and a diluent;

changing the amount of air in said feed gas; and determining the depth of said mineral decomposition zone by monitoring the amount of said carbon dioxide liberated in response to said change.

22. A process in accordance with claim 21 wherein the amount of air is substantially reduced.

23. A process in accordance with claim 21 wherein the inflow of air in said feed gas is stopped.

24. A process in accordance with claim 23 wherein said diluent is selected from the group consisting of steam, carbon dioxide, nitrogen and recycled retort off gases.

25. A process in accordance with claim 21 including measuring the transient response time for said change.

26. A process for use in underground retorting oil shale, comprising the steps of:

igniting a flame front across a generally upright, modified in situ retort;

liberating shale oil and hydrogen saturated gases from said raw oil shale in a kerogen decomposition zone with heat generated by said flame front;

supporting said flame front with a feed gas containing air and a diluent;

changing the amount of air in said feed gas; and determining the depth of said kerogen decomposition zone by monitoring the amount of said hydrogen saturated gases liberated in response to said, change.

27. A process in accordance with claim 21 including monitoring the amount of methane in said hydrogen saturated gases.

28. A process in accordance with claim 26 including monitoring the amount of ethane in said hydrogen saturated gases.

29. A process in accordance with claim 26 including monitoring the amount of propane in said hydrogen saturated gases.

30. A process in accordance with claim 26 wherein said heat thermal cracks said shale oil liberating hydrogen unsaturated gases, and the amount of said thermal cracking is determined by monitoring the amount of said hydrogen unsaturated gases in response to said change.

31. A process in accordance with claim 30 including monitoring the amount of ethylene in said hydrogen unsaturated gases.

32. A process in accordance with claim 30 including monitoring the amount of propylene in said hydrogen unsaturated gases.

33. A process in accordance with claim 26 wherein the inflow of air in said feed gas is substantially stopped.

34. A process in accordance with claim 26 wherein said diluent is selected from the group consisting of steam, carbon dioxide, nitrogen and recycled retort off gases.

35. A process for use in underground retorting of oil shale, comprising the steps of:

igniting a flame front across a generally upright, modified in situ retort to form a hot zone;

liberating shale oil and off gases from said raw oil shale in said hot zone with heat emitted from said flame front, leaving retorted oil shale containing residual carbon;

combusting said residual carbon on said retorted oil shale to form spent oil shale;

advancing said flame front-downwardly through a portion of said raw oil shale;

supporting said flame front with a feed gas consisting essentially of steam and air;

changing the proportion of said steam and said air in said feed gas while supporting said flame front;

analyzing the composition of said off gases with analyzing means consisting essentially of a gas chromatograph and a gas detector; and determining the location and depth of said hot zone by measuring the temperature of said off gases with a thermometer and by measuring the time it takes for the composition of the off gases to change after the proportion of steam and air in said feed gas has been changed with timing means selected from the group consiting essentially of a clock and a stopwatch.

36. A process in accordance with claim 35 including estimating when completion of retorting will occur in response to determining the location of said hot zone in order to determine the extent of retorting.

37. A process in accordance with claim 35 including decreasing the depth of said hot zone by increasing the proportion of steam in said feed gas.

38. A process in accordance with claim 37 including decreasing the rate of said combustion by increasing the proportion of steam in said feed gas, and controling the rate of said advancement of said flame front by regulating the flow of said feed gas.

39. A process in accordance with claim 35 wherein said determining includes determining the location and depth of said spent oil shale.

40. A process in accordance with claim 39 wherein said determining further includes determining the location and depth of said raw oil shale.

41. A process in accordance with claim 40 wherein said determining further includes:

determining the amount of retorted oil shale;

monitoring the amount of shale oil liberated; and determining the yield of shale oil per ton of retorted oil shale.

42. A process in accordance with claim 40 wherein the proportion of said steam and said air in said feed gas is changed at least twice.

43. A process in accordance with claim 42 wherein:

the flow rate of said off gases is monitored; and the depth d of said hot zone is determined in accordance with the equations:

$$d = y - x$$

-continued $$x = \frac{v_{f2}[v_{f1}v_{o1}t_1 - v_{f1}v_{o2}t_2]}{[v_{f2}v_{o1} - v_{f1}v_{o2}]}$$

$$y = \frac{v_{o2}x}{v_{f2}} + L - v_{o2}t_2$$

$$v_{f1} = \frac{HS_f}{m_s c_s(T_{f2} - T_{f1})}$$

$$v_{f2} = \frac{HS_f}{m_c c_s(T_{f3} - T_{f2})}$$

$$v_{o1} = \frac{HS_o}{m_r c_r(T_{o2} - T_{o1})}$$

$$v_{o2} = \frac{HS_o}{m_r c_r(T_{o3} - T_{o2})}$$

where y is the depth from the rubble surface to the bottom of said hot zone; x is the depth from the rubble surface to the top of said hot zone; $v_{f1}$ is the velocity of a first feed gas condensation front passing through said spent oil shale in response to the first change in the proportion of air and steam in said feed gas; $v_{o1}$ is the velocity of a first off gas condensation front passing through said raw oil shale in response to said first change; $v_{f2}$ is the velocity of a second feed gas condensation front passing through said spent oil shale in response to the second change in the proportion of air and steam in said feed gas; $v_{o2}$ is the velocity of a second off gas condensation front passing through said raw oil shale in response to said second change; $t_1$ is the transient response time of said off gas temperature in response to said first change; $t_2$ is the transient response time of said off gas temperature in response to said second change; L is the overall length of said retort; H is the heat of vaporization of said steam; $S_f$ is the flow rate of said feed gas; $m_s$ is the bulk density of said spent shale; $c_s$ is the heat capacity of said spent shale; $T_{f1}$ is the saturation temperature of the feed gas prior to said first change; $T_{f2}$ is the saturation temperature of said feed gas after said first change; $T_{f3}$ is the saturation temperature of said feed gas after said second change; $S_g$ is the flow rate of said off gases; $m_r$ is the bulk density of said raw oil shale; $c_r$ is the heat capacity of said raw oil shale; $T_{o1}$ is the saturation temperature of said off gases prior to said first change; $T_{o2}$ is the saturation temperature of said off gases after said first change; and $T_{o3}$ is the saturation temperature of said off gases after said second change.

* * * * *

UNITED STATES PATENT OFFICE

CERTIFICATE OF CORRECTION

Patent No. 4,457,374 Dated July 3, 1984

Inventor(s) George R. Hoekstra, John M. Forgac

It is certified that error appears in the above-identified patent and that said Letters Patent are hereby corrected as shown below:

| Patent Column | Line | |
|---|---|---|
| 1 | 65 | reads "opera-tion" and should read --operation-- |
| 8 | 68 | reads "vf and vo" and should read $v_f$ and $v_o$-- |
| 14 | 17 | reads "front-downwardly" and should read --front downwardly-- |

Signed and Sealed this

Sixth Day of August 1985

[SEAL]

*Attest:*

DONALD J. QUIGG

*Attesting Officer* *Acting Commissioner of Patents and Trademarks*